US005239846A

United States Patent [19]

Kitaura et al.

[11] Patent Number: 5,239,846

[45] Date of Patent: Aug. 31, 1993

[54] KNITTED GLOVES AND METHOD OF PROCESSING EDGES OF GLOVES IN THE KNITTING PROCESS

[75] Inventors: Shuji Kitaura; Nobuyuki Isozaki, both of Wakayama, Japan

[73] Assignee: Shima Seiki Mfg., Ltd., Wakayama, Japan

[21] Appl. No.: 846,851

[22] Filed: Mar. 6, 1992

[30] Foreign Application Priority Data

Mar. 8, 1991 [JP] Japan ..... 3-43395

[51] Int. Cl.[5] ..... D04B 7/34; D04B 9/58

[52] U.S. Cl. ..... 66/174; 66/65; 66/172 R

[58] Field of Search ..... 66/14, 65, 172 R, 174; 2/159, 169

[56] References Cited

U.S. PATENT DOCUMENTS

| | | | |
|---|---|---|---|
| 2,150,336 | 3/1939 | Miller et al. . | |
| 3,516,266 | 6/1970 | Heggie | 66/172 R |
| 3,875,768 | 4/1975 | Arndt | 66/172 R |
| 3,916,647 | 11/1975 | Yabuta | 66/174 X |
| 4,073,164 | 2/1978 | Shima | 66/174 X |
| 4,750,339 | 6/1988 | Simpson, Jr. et al. | 66/172 R |

FOREIGN PATENT DOCUMENTS

| | | | |
|---|---|---|---|
| 198732 | 12/1907 | Fed. Rep. of Germany | 66/174 |
| 0002756 | 1/1985 | Japan | 66/174 |
| 3152442 | 6/1988 | Japan | 66/174 |
| 0578383 | 10/1977 | U.S.S.R. | 66/174 |
| 24964 | of 0524 | United Kingdom | 66/174 |

*Primary Examiner*—Clifford D. Crowder
*Assistant Examiner*—John S. Calvert
*Attorney, Agent, or Firm*—Edwin E. Greigg; Ronald E. Greigg

[57] ABSTRACT

A method for knitting gloves and a glove so knitted by a flat knitting machine which includes forming stitches of several circumferential courses of the knitted material which make up the wrist edge aperture domain. The method uses a knitting process in which the wrist-edge aperture domain of the glove can be turned into a pouched tubular shape in which at least one course on the top edge of the pouched tubular domain is knitted by means of a thermofusing yarn and then thermally fused.

5 Claims, 6 Drawing Sheets

KNITTED GLOVES AND METHOD OF PROCESSING EDGES OF GLOVES IN THE KNITTING PROCESS

BACKGROUND OF THE INVENTION

The present invention relates to a tubular knit fabric like gloves knitted by operating a flat knitting machine and a method of executing specific processes to prevent wrist-edge domains of the tubular knit fabric from incurring disintegration of stitched yarns.

Conventionally, gloves are knitted by operating a glove knitting machine in those sequential orders cited below. Initially, four finger domains corresponding to the little finger, third finger, middle finger, and the forefinger, are respectively formed, followed by formation of the four-finger body, the thumb, and the five-finger body. Next, the wrist domains and the wrist-edge aperture domains are automatically knitted before the processed gloves are eventually disengaged from the glove knitting machine.

Nevertheless, those gloves disengaged from the glove knitting machine are not yet complete with the final process for preventing the knitted stitches from disintegrating themselves, and therefore, these gloves are not yet offerable on the market.

Conventionally, wrist-edge aperture domain is treated with a darning process by operating an overlocking machine to prevent the edge yarns from disintegrating themselves. However, in order to execute the darning process, an additional sewing process must be executed after formation of the knitted gloves. This in turn results in an increased cost in the production of gloves.

Therefore, in order to solve the problems inherent in the conventional practice, a variety of methods have thus been proposed by a number of applicants including the applicant related to the invention.

Typically, the proposed method initially forms stitches of several circumferential courses of the knitted terminal including those courses supposed to make up the wrist-edge aperture domain on the way of knitting gloves with those yarns capable of restraining knitted yarns from disintegrating themselves before the formed several-round stitches are subject to a thermal treatment so that the wrist-edge yarns can be prevented from disintegrating themselves.

There are a variety of yarns which are available for preventing wrist-edge stitches from disintegration like the one related to the method proposed by the Japanese Patent Laid-Open Publications No. 58-163703 of 1983, No. 51-122532 of 1976, and others. These methods disclosed in the Japanese Patent Publications No. 60-52222 of 1985 and No. 61-17938 of 1986 are widely made available today.

Concretely, those yarns available for prevention of wrist-edge stitches from incurring disintegration cited for explanation of the above methods are respectively alleged to be free from incurring disintegration by virtue of the execution of those sequential processes including the following: Initially, thermally contractile core-forming elastic yarns are encircled in conjunction with those yarns which are free of thermal fusibility and thermohardening property and available for covering the core elastic yarns, and then, these yarns are superficially added with thermofusing yarns to be encircled in conjunction with the above yarns in the direction opposite from each other. These encircled yarns are made available for composing stitches of several-round courses of the knitted terminal including those courses supposed to make up wrist-edge aperture domain on the way of knitting gloves. This in turn permits intersections between needle loops and sinker loops of stitches of continual courses to adhere to each other due to thermally fused effect of thermofusing yarns, thus allegedly restraining the wrist-edge stitches from disintegrating themselves.

Nevertheless, as mentioned above, when knitting conventional gloves using the above-cited yarns for preventing the wrist-edge aperture domain from disintegration, these yarns are knitted into stitches corresponding to several-round courses at the knitted terminal including those courses which are supposed to make up the wrist-edge aperture domain.

However, since the conventional knitting process is executed by feeding those yarns to all the knitting needles which are commonly available for the knitting of wrist domain as well as for retaining stitches of the wrist edge so that knitted yarns at the wrist edge domain can be prevented from disintegrating themselves. In consequence, the wrist edge domain cannot fully be fastened by applying thereon contracting effect of those yarns provided for preventing the wrist-edge aperture domain from incurring disintegration, but the wrist-edge aperture domain is apt to turn into trumpet-like shape, thus seriously degrading appearance of the knitted gloves.

To solve this problem, conventionally, on the way of knitting the wrist-edge aperture domain, rubber yarns available for fastening the wrist-edge aperture domain are tacked on those courses respectively being composed of those yarns for preventing the wrist-edge yarns from disintegration in order to strengthen the fastening force of the wrist-edge aperture domain.

This method certainly generates such force enough to fasten the wrist-edge aperture domain. On the other hand, this method in turn causes specific problems to arise.

Concretely, since the wrist-edge aperture domain is jointly knitted with rubber yarns, rubber yarns is apt to visibly show up from the wrist-edge aperture domain to adversely affect the appearance of the knitted gloves.

Furthermore, consumable amount of rubber yarns adds up the production cost. In addition, execution of those conventional methods cited above also causes a variety of problems to arise. These problems are described below.

Using all the knitting needles available for the knitting of wrist domains, the conventional method knits the wrist-edge aperture domain by following identical plain knitting processes, and therefore, the final-course loop of the edge domain is unavoidably positioned at the wrist-edge aperture domain. When a consumer tries to put the knitted gloves on, his fingers may easily be caught by the final-course loop, and as a result, despite the preventive measure, looped yarns are easily disintegrated from each other. Furthermore, presence of the final-loop yarns causes the wearer to feel uncomfortable because the looped yarns directly come into contact with the wearer's wrist skin.

SUMMARY OF THE INVENTION

The object of the invention is to fully solve those problems described above by providing a novel method of preventing those looped yarns jointly making up a wrist-edge aperture domain from disintegrating themselves on the way of the glove knitting process and novel gloves which are properly knitted by executing the method embodied by the invention.

To securely achieve the above objects, the method embodied by the invention characteristically executes those novel processes described below.

Using a flat knitting machine, when knitting those stitches corresponding to several-round courses at the knitted terminal including those courses which are supposed to make up a wrist-edge aperture domain, the method embodied by the invention executes a knitting process so that the wrist-edge aperture domain can be turned into a pouched tubular shape, wherein at least one round course on the top edge of the pouched tubular domain is knitted by means of thermofusing yarns which are capable of preventing the wrist-edge yarns from disintegrating from each other, followed by a process for disengaging knitted gloves from the knitting machine before eventually treating the disengaged gloves with a heating process to thermally fuse those disintegration preventive yarns so that those yarns positioned at the edge of the knitted fabric can securely be prevented from disintegrating from each other.

As another characteristic aspect of the invention, on the way of knitting up stitches corresponding to several-round courses including those courses which are supposed to make up a wrist-edge aperture domain while the glove knitting process is underway, using those yarns available for preventing knit-component yarns from disintegrating themselves, a process for knitting those several-round courses is executed in succession to the preceding process for knitting a wrist domain. At the same time, part of those knitting needles are jointly rested in position by disengaging loops from following up the process for knitting the wrist-edge aperture domain to make up several rounds of courses by operating the remaining needles, and then, those needles at rest are brought back to operating condition before jointly encircling the top-edge loop with the bottom-edge loop of the wrist-edge domain so that the pouched tubular form of the wrist-edge aperture domain can properly be shaped up. To execute this method, those yarns available for preventing the knit-component yarns from disintegrating from each other may be of the composition described below. Using thermally contractile core-forming elastic yarns, those yarns free of thermal fusibility and thermal hardening property are jointly encircled to cover the core-forming elastic yarns, and yet, thermally fusible yarns may be provided on the external circumference of these yarns covering the core-forming elastic yarns in the direction opposite from each other.

The gloves knitted by operating a flat knitting machine and as per the method embodied by the invention featuring the composition described below. Using elastic yarns, pouched tubular stitches corresponding to several-round courses including those courses which are supposed to make up a wrist-edge aperture domain are provided, and in addition, stitch a of the course in succession to those several-round-course stitches are formed by means of those disintegration preventive yarns, where those stitches following those of the several-round courses are thermally fused, thus securely achieving the aimed prevention of the final stitch from incurring disintegration of knitted yarns.

Concretely, when engaging part of the knitting needles with loops, stitches corresponding to several-round courses including those courses which are supposed to make up a wrist-edge aperture domain on the way of knitting gloves are retained at a rest position, and then, using the remaining needles and in succession to the wrist domain, several-round courses of the wrist-edge aperture domain are knitted by means of those elastic yarns or the disintegration preventive yarns.

In consequence, since those stitches of the wrist-edge aperture domain are disposed in the tensional condition relative to the stitch of an adjoining course, these stitches respectively function themselves in the direction to fully strengthen a force to fasten the wrist-edge aperture domain. At the same time, in order to bring those needles at rest back to operating condition to resume the knitting operation, the top edge of the knitted fabric corresponding to the wrist-edge aperture domain bends backwards before eventually being knitted together with the other base edge of the knitted fabric, thus completing formation of a pouched tubular knitted fabric. Finally, the knitted gloves are thermally treated to secure a substantial force to restrain unwanted disintegration of edge-stitch component yarns at the wrist-edge aperture domain by virtue of the thermally fused effect of the disintegration preventive yarns.

DETAILED DESCRIPTION OF THE PREFERRED EMBODIMENTS

Figure 1:
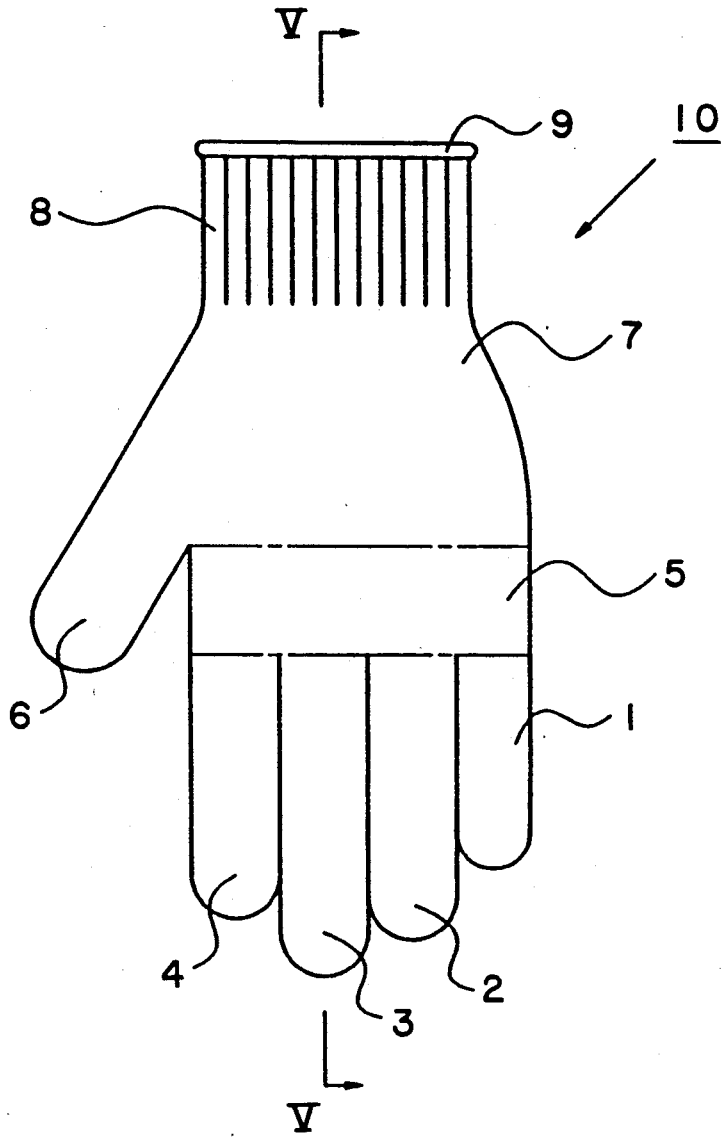
FIG. 1 is the schematic front view of the glove knitted by executing the method embodied by the invention.

Referring now more particularly to the accompanying drawings, a detailed structure of gloves and the method of manufacturing them embodied by the invention are described below. To execute the method embodied by the invention, as shown in FIG. 1 and like the conventional practice, each glove 10 is sequentially knitted in order of the little finger 1, third finger 2, middle finger 3, forefinger 4, the four-finger body 5, thumb 6, the five-finger body 7, wrist domain 8, and finally the shaped wrist-edge aperture domain 9. However, characteristically, the invention embodies the novel gloves 10 and the novel method of knitting these gloves 10 by properly knitting those stitches corresponding to several rounds of courses including those which are supposed to make up the wrist-edge aperture domain 9 by way of materializing the first through third embodiments.

The First Embodiment

Figure 2:
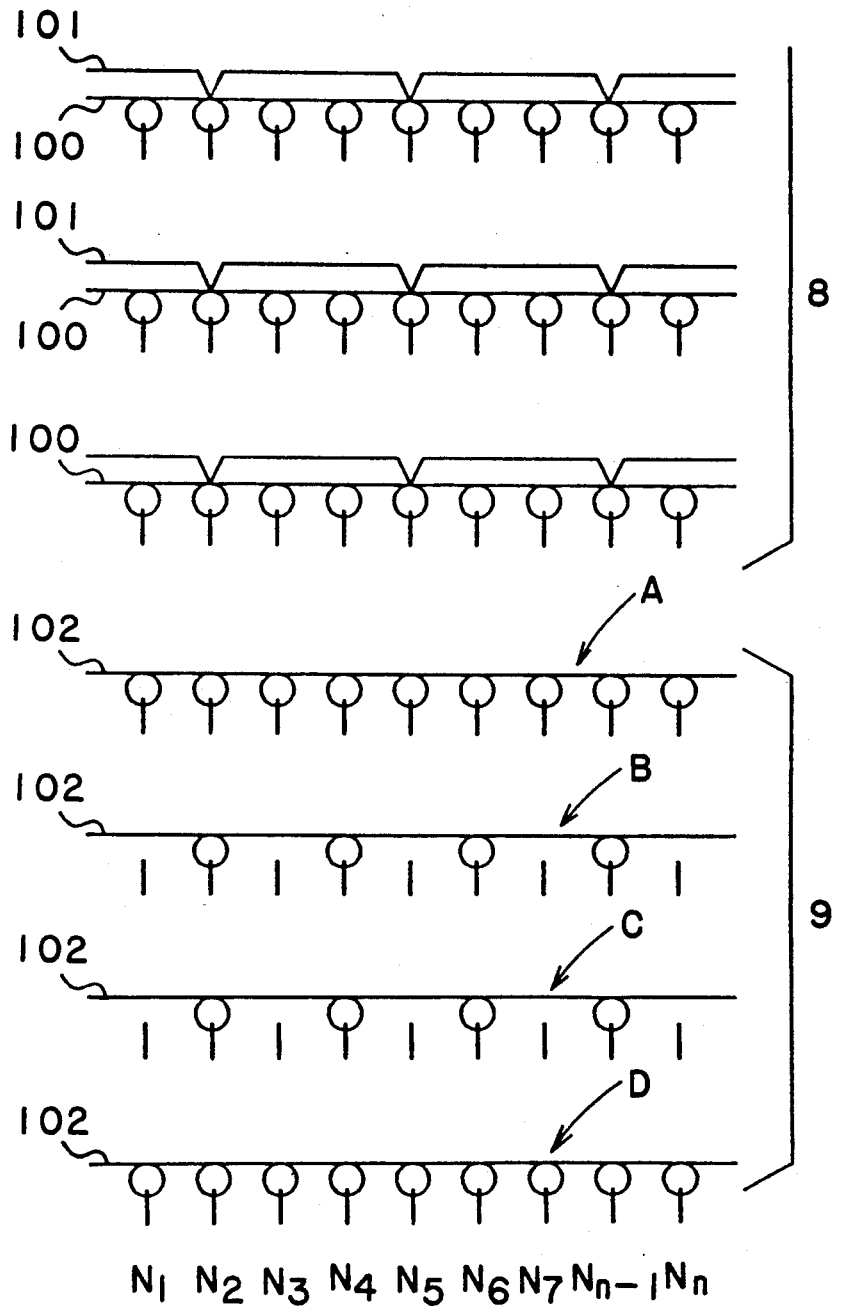
FIG. 2 is the chart schematically illustrating the composition of the knitted fabric according to the first embodiment of the invention.

As shown in FIG. 2, initially, the method embodied by the invention knits those glove components up to the five-finger body (not shown) by means of knitting yarns 100, and then knits the wrist domain 8 with the knitting yarns 100 and rubber yarns 101. Next, in place of those knitting yarns 100 and the rubber yarns 101, the method embodied by the invention knits up the wrist-edge aperture domain 9 by means of thermally fusible disintegration preventive yarns 102.

Although not being illustrated, those disintegration preventive yarns 102 available for the knitting of the wrist-edge aperture domain 9 are substantially composed of thermally fusible yarns or those yarns consisting of a core yarn encircled with thermally fusible yarns.

When the initial knitting course A is entered by applying the disintegration preventive yarns 102, the knitting operation is executed by activating all the knitting needles N1 through Nn which are made available for knitting the wrist domain 8.

Next, when the following second and third knitting courses B and C are respectively entered, of those needles activated for executing the initial knitting course A, those needles including N1, N3, N5, N7, and Nn−1, are respectively laid off from operation. On the other hand, those remaining needles including N2, N4, N6, and Nn, are respectively activated to execute the second and third knitting courses B and C.

When the following fourth knitting course D is entered, those needles including N1, N3, N5, N7, and Nn−1 thus far laid off from operation are respectively brought back to operating condition, and simultaneously, those disintegration preventive yarns 102 are delivered to all the operating needles N1 through Nn to follow the knitting operation.

Next, the bottom-edge loops of those odd needles N1, N3, N5, N7, and Nn−1, are jointly knitted in conjunction with the top loops of those even needles N2, N4, N6, and Nn thus far made available for the second and third knitting courses B and C on the way of processing the fourth knitting course D, and then, a pouched tubular knit cloth is eventually formed.

Next, the knitted gloves 10 are disengaged from the knitting machine, and then the gloves 10 are thermally treated by use of a hot iron or any other heating means. In consequence, the twisted domains of the disintegration preventive yarns are thermally fused together to effectuate prevention of those yarns around the wrist-edge aperture domain from incurring disintegration and retention of the force to prevent disintegration from occurrence, thus securely preventing the stitches around the wrist-edge aperture domain from expanding themselves into a trumpet-like configuration.

The Second Embodiment

Figure 3:
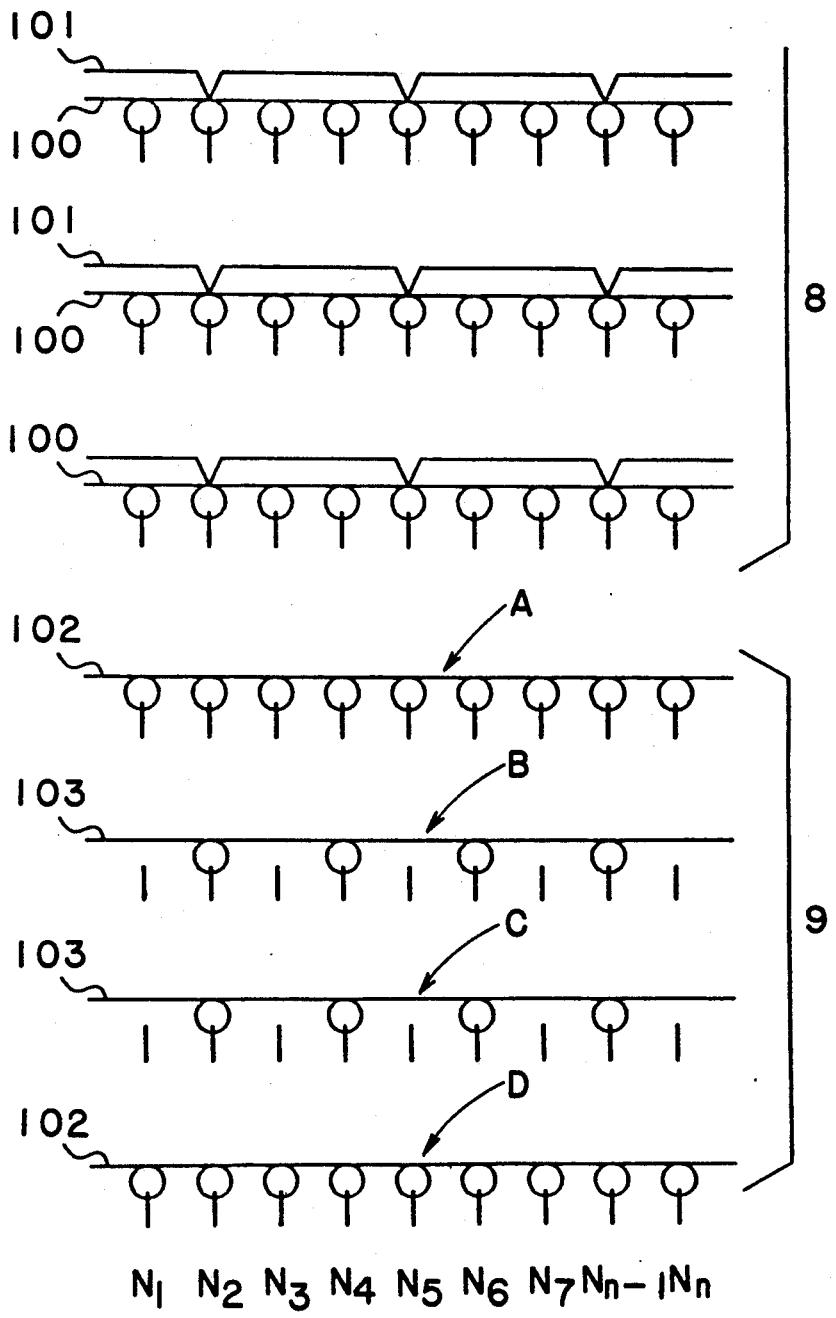
FIG. 3 is the chart schematically illustrating the composition of the knitted fabric according to the second embodiment of the invention.

As shown in FIG. 3, initially, the method embodied by the invention knits those glove components up to the five-finger body (not shown) by means of knitting yarns 100, followed by the knitting of the wrist-domain 8 with the knitting yarns 100 and rubber yarns 101. Next, instead of using the knitting yarns 100 and the rubber yarns 101, the method embodied by the invention knits the wrist-edge aperture domain 9 in the initial knitting course A by applying thermally fusible disintegration preventive yarns 102.

When the following second and third knitting courses B and C are activated, of those knitting needles N1 through Nn made available for the knitting of the wrist domain 8, those odd needles N1, N3, N5, N7, and Nn−1, are respectively laid off from operation. Instead, elastic yarns 103 are delivered to those remaining even needles N2, N4, N6, and Nn to follow execution of the glove knitting operation.

When the following fourth knitting course D is activated, instead of using the elastic yarns 103 made available for executing the second and third knitting courses B and C, those odd needles including N1, N3, N5, N7, and Nn−1 thus far being laid off from operation are respectively brought back to operating condition, and simultaneously, those disintegration preventive yarns are delivered to all the operating needles N1 through Nn to follow up execution of the glove knitting operation.

Next, those loops of the odd knitting needles N1, N3, N5, N7, and Nn−1 laid off from operation in the second and third knitting courses B and C are jointly knitted together with those loops of the even knitting needles N2, N4, N6, and Nn made available for processing the second and third knitting courses B and C, thus eventually forming a pouched tubular knit cloth.

Next, the knitted gloves are disengaged from the knitting machine and then subject to a thermal treatment. As a result, the encircled domains of the disintegration preventive yarns are thermally fused together to effectuate prevention of those yarns around the wrist-edge aperture domain from incurring disintegration and retention of the force to prevent them from disintegrating themselves, thus securely preventing the wrist-edge aperture domain from expanding itself into a trumpet-like configuration.

The Third Embodiment

Figure 4:
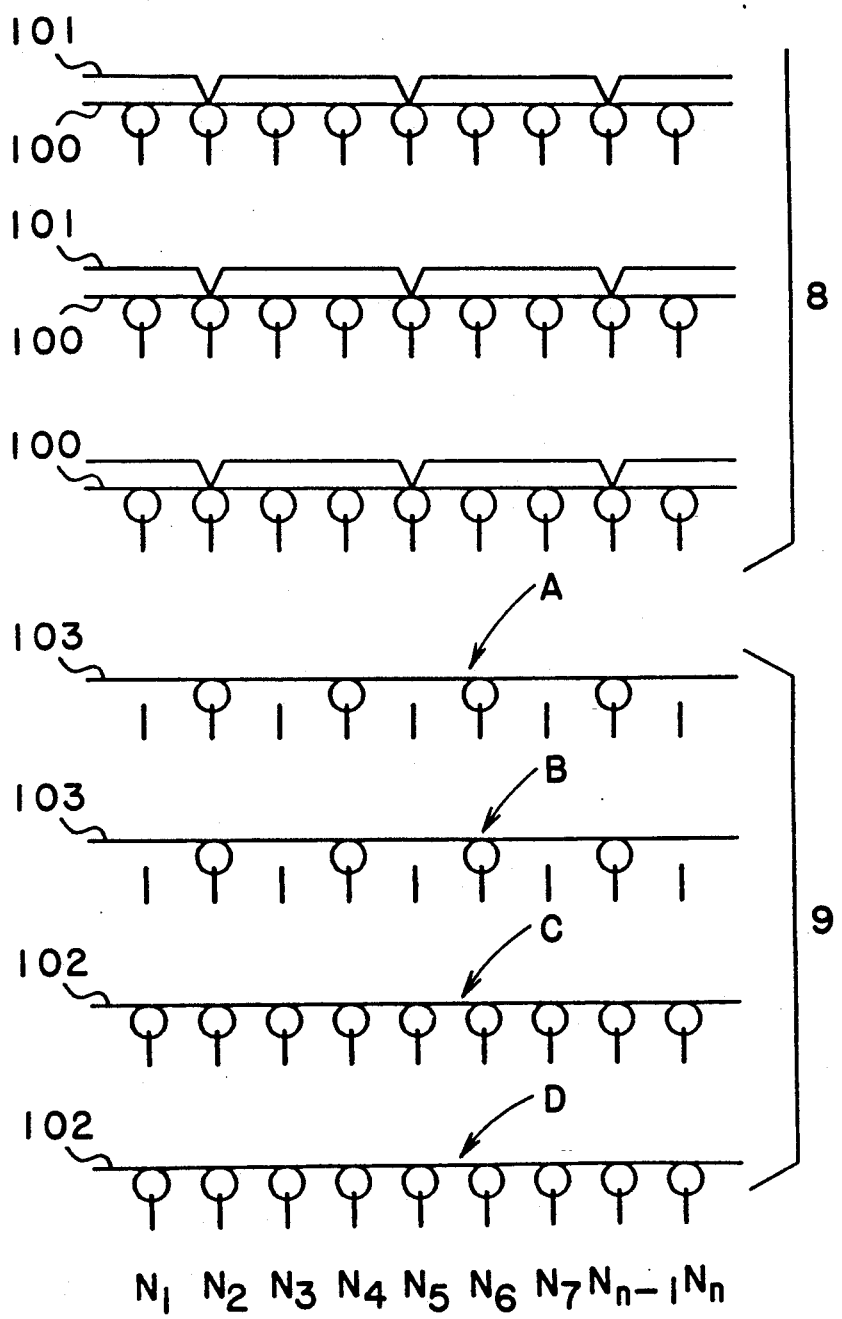
FIG. 4 is the chart schematically illustrating the composition of the knitted fabric according to the third embodiment of the invention.

As shown in FIG. 4, initially, the method embodied by the invention knits those glove components up to the five-finger body (not shown) by means of those knitting yarns 100, and then knits the wrist domain 8 with those knitting yarns 100 and rubber yarns 101. Next, of those knitting needles N1 through Nn made available for the knitting of the wrist domain 8 in the first and second knitting courses A and B on the way of knitting the wrist-edge aperture domain 9, those odd needles N1, N3, N5, N7, and Nn−1, are respectively laid off from operation. Next, instead of using those yarns 100 and rubber yarns 101 made available for the knitting of the wrist domain 8, elastic yarns 103 are delivered to the remaining even needles N2, N4, N6, and Nn to follow up execution of the glove knitting operation.

When the third and fourth knitting courses C and D are respectively activated, those odd needles N1, N3, N5, N7, and Nn−1 thus far being laid off in the preceding knitting courses A and B are brought back to operating condition, and simultaneously, in place of those elastic yarns 103, those thermally fusible disintegration preventive yarns 102 are delivered to all the operating needles N1 through Nn to follow up the execution of the glove knitting operation. Finally, the knitted gloves are disengaged from the knitting machine to complete the whole knitting processes.

The knitted gloves are thus disengaged from the knitting machine and then subjected to a thermal treatment. As a result, those domains of the knitting yarns 100 in contact with the disintegration preventive yarns 102 are thermally fused with those yarns 102 to effectuate prevention of those yarns around the wrist-edge aperture domain 9 from incurring unwanted disintegration and also retention of the disintegration preventive force, thus securely preventing the wrist-edge aperture domain 9 of the knitted glove 10 from expanding itself into a trumpet-like configuration.

Figure 5:
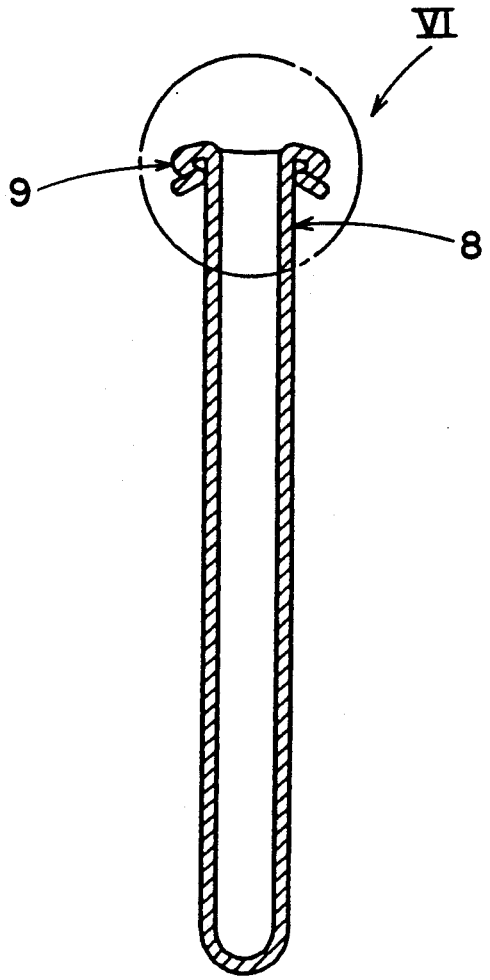
FIG. 5 is the sectional view of the glove shown in FIG. 1 taken on line V through V.
Figure 6:
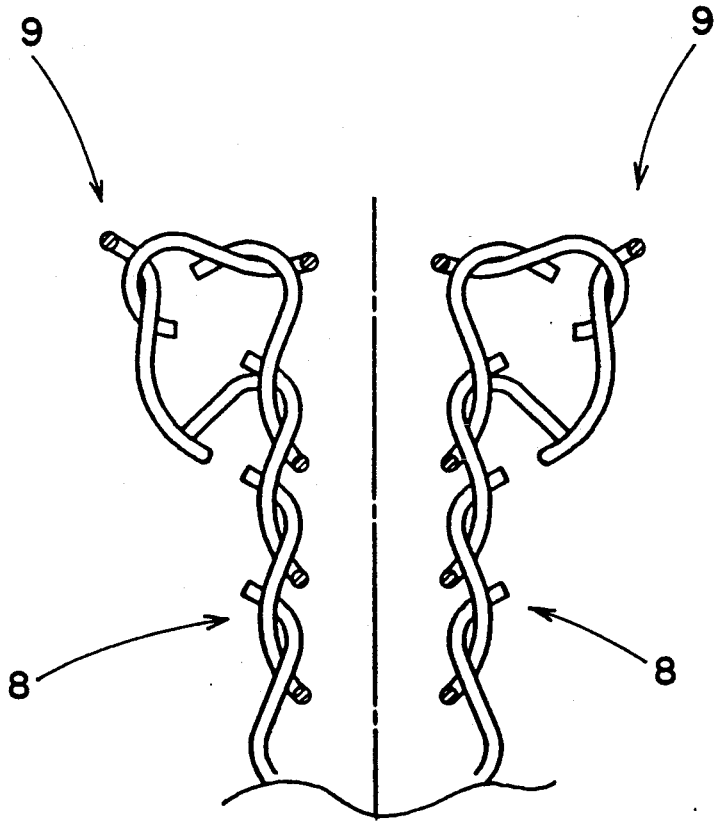
FIG. 6 is the enlarged view of the domain VI shown in FIG. 5.

FIGS. 5 and 6 respectively illustrate the shape of the wrist-edge aperture domain 9 of the knitted glove 10 after being knitted and thermally treated by executing the method embodied by the invention.

Concretely, by executing a knitting operation in succession to the reactivation of those needles thus far being laid off, the top edge of the knitted cloth corresponding to the wrist-edge aperture domain 9 bends backward before jointly being twisted with the base edge of the identical knit cloth. In consequence, by virtue of the thermally fused effect of the disintegration preventive yarns 102, the configuration of the punched tubular knit is securely preserved.

Those embodiments described above respectively present ideal application of the art embodied by the invention, in which the process for knitting the wrist-edge aperture domain is completed by processing four-round courses. Nevertheless, as a matter of course, the number of knitting course may optionally be variable.

For example, the first embodiment may also be executed by practically making the pouched tubular knit to be more voluminous by slightly increasing the composition of the second knitting course knitted by applying those disintegration preventive yarns 102. Furthermore, variation of the above embodiments may also be materialized by executing those processes described below. After combining the base edge of the pouched tubular knit with the top edge thereof by additionally providing the knitting course with the disintegration preventive yarns 102, stitches formed by these yarns 102 are disposed in continual courses after completing the knitting of the final round course, and then strengthen the effect of preventing the stitch of the final-round course from being disintegrated by strengthening the thermal fusing effect while executing a thermal treatment.

This variational method may be executed in the event that neither fusion nor adhesion of the disintegration preventive yarns 102 is fully materialized during the thermal treatment and then results in the failure to securely prevent the stitch of the final-round course from disintegration caused by the kind of the knitting yarns 101 or the elastic yarns 104 after completing formation of stitches of continual courses by combining those knitting yarns 100 with the disintegration preventive yarns 103 or combining the elastic yarns 104 with the disintegration preventive yarns 103.

The above embodiments have respectively provided 1:1 of the even ratio between those laid-off needles and those needles activated during the glove knitting process using those elastic yarns containing the disintegration preventive yarns. Nevertheless, it is also practical for the invention to properly adjust the force to fasten the wrist-edge aperture domain by varying the above ratio into either 1:2 or 2:2 within the scope that does not deviate from the fundamental points of the invention.

It is needless to say, especially in the third embodiment, that disintegration preventive yarns used in the present invention may be core-forming elastic yarns encircled with thermal fusible yarns, or core-forming elastic yarns encircled with yarn free of thermal fusibility and thermal curable properties and superposedly encircled with thermally fusible yarns so that the encircling yarns are in a direction opposite from each other.

What is claimed is:

1. A method of processing an edge domain in a process of knitting gloves with a glove knitting machine including knitting needles, the method being employed for knitting several last courses including courses which form a wrist-edge aperture domain, comprising:

knitting the last several courses in order that the last several courses form a pouched tubular configuration, inactivating alternate knitting needles with loops of yarn held on the inactivated knitting needles, knitting several last courses by active alternate knitting needles, activating the alternate inactive knitting needles and the loops held on the once inactivated knitting needles and loops at the knitting end of the wrist-edge aperture domain are jointly knitted to form the pouched tubular configuration;

knitting at least one last course of the pouched tubular knit cloth with disintegration preventive yarn containing thermally fusible properties;

disengaging the knitted gloves from the glove knitting machine; and thermally treating the gloves to cause the disintegration preventive yarn to be fused so that an edge domain of the knit cloth is prevented from being disintegrated.

2. A method of processing edge domain in a process of knitting gloves with a glove knitting machine in claim 1, comprising:

knitting courses in succession to the knitting of wrist domain with disintegration preventive yarn; and thermally treating the gloves to cause the disintegration preventive yarns to be fused with each other so that the wrist-edge aperture domain of the knit cloth is prevented from being disintegrated.

3. A method of processing an edge domain in a process of knitting gloves with a glove knitting machine as in claim 1, wherein the disintegration preventive yarns consist of a thermally contractile elastic yarn as a core-forming yarn, the core-forming yarn being encircled with yarn free of thermal fusibility and thermally curing properties and superposedly encircled with thermally fusible yarn so that the encircling yarns are in a direction opposite from each other.

4. A method of processing an edge domain in a process of knitting gloves with a glove knitting machine as in claim 3, wherein the disintegration preventive yarn consists of thermally contractile elastic yarn as a core-forming yarn, the core-forming yarn being encircled with yarn free of thermal fusibility and thermally curing properties, and superposedly encircled with thermally fusible yarn so that the encircling yarns are in a direction opposite from each other.

5. A glove which is knitted by a glove knitting machine including knitting needles comprising:

a pouched tubular configuration formed by the last several courses which includes those courses which form a wrist-edge aperture domain;

said pouched tubular configuration formed of at least two courses knit on at least alternate needles connecting with the body of the glove;

the at least two courses followed by at least one last course connected to the body of the glove;

said pouched tubular configuration having four courses;

said at least one last course of the pouched tubular knit cloth knitted with disintegration preventive yarns containing thermal fusing properties; and a wrist-edge aperture domain of the knit cloth fused by thermal treatment of the disintegration preventive yarn, after disengaging the knitted gloves from the glove knitting machine, so that disintegration is prevented.

* * * * *